US005088649A

United States Patent [19]

Hanson et al.

[11] Patent Number: 5,088,649

[45] Date of Patent: Feb. 18, 1992

[54] PUMP SPRAYABLE DISPENSING SYSTEM FOR VEGETABLE OIL BASED PAN COATINGS

[75] Inventors: H. Wayne Hanson, La Quinta; Beauford C. Doering, Santa Ana, both of Calif.

[73] Assignee: Par-Way Group, Costa Mesa, Calif.

[21] Appl. No.: 553,786

[22] Filed: Jul. 12, 1990

[51] Int. Cl.[5] ..... B05B 1/26

[52] U.S. Cl. ..... 239/329; 239/543

[58] Field of Search ..... 239/543-545, 239/333, 331, 329

[56] References Cited

U.S. PATENT DOCUMENTS

| | | | |
|---|---|---|---|
| 1,055,789 | 3/1913 | Fedorofs . | |
| 2,302,021 | 11/1942 | Freeman | 239/543 |
| 2,742,326 | 4/1956 | Borges | 239/544 |
| 2,785,926 | 3/1957 | Lataste . | |
| 2,812,213 | 11/1957 | Bede | 239/544 |
| 2,930,532 | 3/1960 | Johnson | 239/543 X |
| 3,125,298 | 3/1964 | Iwata | 239/543 |
| 3,366,337 | 1/1968 | Brooks et al. | 239/545 X |
| 3,406,913 | 10/1968 | Frangos . | |
| 3,568,933 | 12/1971 | Macquire-Cooper | 239/543 |
| 3,701,478 | 10/1972 | Tada | 239/333 |
| 3,761,022 | 9/1973 | Kondo | 239/333 |
| 4,127,419 | 11/1978 | Szuhay et al. | 106/243 |
| 4,142,003 | 2/1979 | Sejpal | 426/601 |
| 4,155,770 | 5/1979 | Doumani | 106/267 |
| 4,591,077 | 5/1986 | Corsette | 222/321 |
| 4,646,969 | 3/1987 | Sorm . | |

OTHER PUBLICATIONS

922 Industrial Sprayer; Continental Mantotg Co. pp. 6 & 7.

*Primary Examiner*—Andres Kashikow
*Assistant Examiner*—Kevin P. Weldon
*Attorney, Agent, or Firm*—James A. Quinton; Frank Frisenda, Jr.

[57] ABSTRACT

A nozzle assembly is interconnected with the delivery passageway or conduit from a hand pump sprayer. The nozzle assembly has a first and second passageway, preferably conduits which are connected to the delivery passageway or conduit and splits the fluid preferably pan coating exiting from the delivery passageway or conduit into two streams. The cross sectional flow area of the first and second conduit is smaller than the cross sectional flow area of the delivery conduit so that the velocity of the pan coating increases upon entry into the first and second conduits located in the nozzle assembly. Each conduit has a fluid outlet to the atmosphere. The first and second conduits in combination with said fluid outlets define a discharge axis. The first fluid conduit discharge axis intersects the second fluid discharge axis at an impingement angle $\beta$ of from 10° to 170° preferably from 60° to 140° so that the pan coating exiting each outlet intersects at a point exterior to the nozzle. As a result the pan coating exiting the first outlet collides with the pan coating exiting from the second outlet to break the pan coating into small droplets to form a wide angle mist for application to a cooking surface. The impingement angle should be sufficiently high so that there is sufficient collision of the streams to form fine drops while at the same time preserving a sufficient forward velocity so that the pan coating can be sprayed on a cooking surface between 6 inches and 24 inches from the nozzle.

37 Claims, 3 Drawing Sheets

FIG. 1
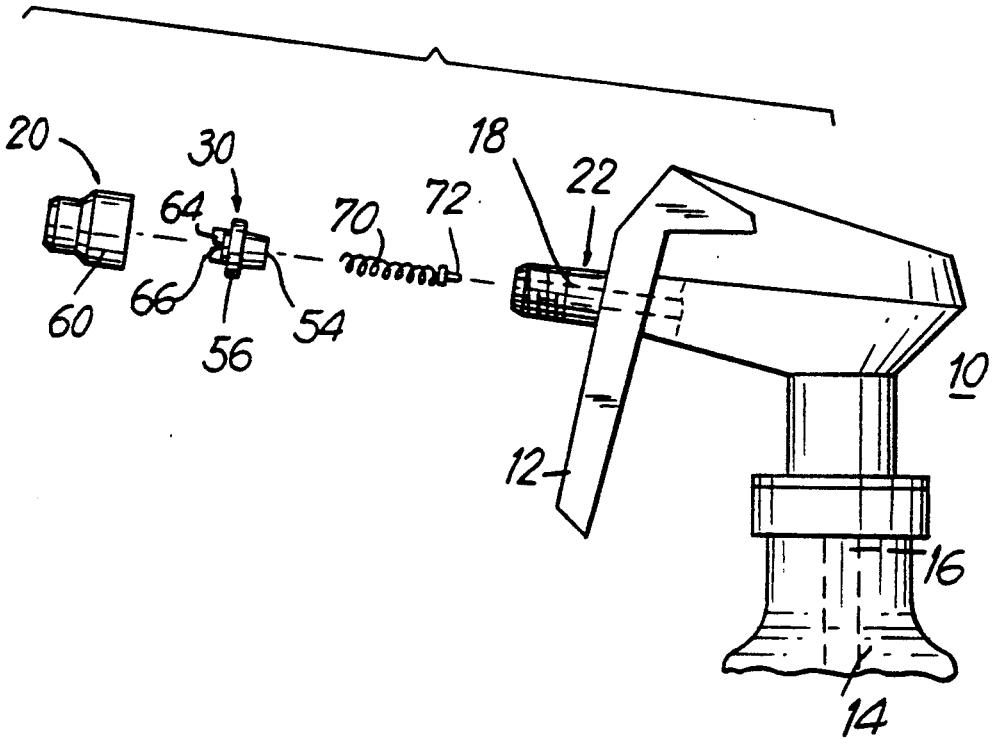
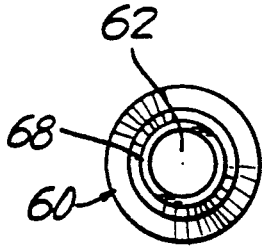
FIG. 5

PUMP SPRAYABLE DISPENSING SYSTEM FOR VEGETABLE OIL BASED PAN COATINGS

FIELD OF THE INVENTION

The field of the invention is vegetable oil based pan coatings and in particular a dispensing system for viscous pan coatings containing vegetable oil and lecithin.

DESCRIPTION OF THE PRIOR ART

Lecithin has been recognized as an advantageous cooking lubricant and release agent. Commonly lecithin is combined with vegetable oil to provide a edible pan release agent. However, there have been difficulties encountered in providing a readily sprayable pan release agent. The lecithin, vegetable oil compositions have rather high viscosity and have proved difficult to pump. For example, a 90% vegetable oil (soybean oil) mixed with 10% lecithin would have an approximate viscosity at 66° F. of 87 cps.

Considerable efforts have been made to provide spray dispensable lecithin, vegetable oil compositions. Aerosol compositions have been provided in the prior art. Many of such compositions employ the use of chlorofluoro hydrocarbon propellant or other hydrocarbon propellants. For example, U.S. Pat. No. 3,896,975 (Follmer) shows such an aerosol composition.

Considering the possible harmful effects of fluorocarbons on the ozone layer, it is now desirable to avoid their uses in food products. Efforts to eliminate the use of the chlorofluoro hydrocarbons have resulted in the substitution of such propellant with isobutane or propane or other hydrocarbon propellants. In addition, it has been found to have a sprayable composition in such a form, it is necessary to dilute the composition with a solvent such as ethyl alcohol. See for example, U.S. Pat. No. 4,188,412 (Sejpal). However, substitution of the chlorofluoro hydrocarbons with other hydrocarbons and the use of an ethyl alcohol solvent still results in the use of volatile hydrocarbons which can have adverse environmental effects and may be flammable. Ethyl alcohol is considered a volatile organic compound (VOC). It is environmentally desirable to remove VOC from products used by the consumer because VOC is a component of smog. Thus, it would be desirable to remove the aerosol hydrocarbon propellants and alcohol solvents altogether from pan coating and have a pump sprayable product.

Pump sprayable pan coatings products have been developed in the prior art. It has been recognized that products having a viscosity in excess of 60 cps are not suitable for use in pump sprayers. See U.S. Pat. No. 4,142,003 (Sejpal). This has created a problem in obtaining pump sprayable pan coating because pan coatings often have a viscosity in excess of 60 cps. Thus, for example the prior art shows that a 6% lecithin, 94 soybean oil composition has a viscosity of about 82 cps at 66° F., a 10% lecithin, 90% soybean oil composition has a viscosity of 87 cps at 66° F., and 100% soybean oil has a viscosity of 75 cps at 66° F. A viscosity of 60 cps is generally considered as the upper limit for pump spraying.

Some prior art products have added ethyl alcohol as a diluent to reduce the viscosity of vegetable oil, lecithin composition to a point where it can be pump sprayed. See for example, U.S. Pat. No. 4,142,003 (Sejpal) and U.S. Pat. No. 4,127,419 (Szuhaj). Other diluents have been used to provide pump sprayable product for example, white mineral oil. See U.S. Pat. No. 4,155,770 (Doumani). However, ethanol containing compositions can cause difficulties. The ethanol can be present in amounts up to 15%. Since ethanol is a VOC, it is an undesirable pollutant and a component of smog. In addition, the pan coatings sprays are used in cooking and the use of the ethanol can be an undesirable fire hazard. Thus, it would be desirable to remove all VOC from pan coatings.

Water has been proposed as a diluent to provide a pump sprayable product. However, vegetable oil, water products have proved undesirable in the pump spray environment since the water promotes the growth of bacteria in the product. Thus, a pump sprayable system containing vegetable oil and lecithin which is water free and does not employ hydrocarbon pollutant diluents or hydrocarbons aerosol propellants would be a desirable product as a pan coating.

Pump sprayers of the trigger type have been widely used to spray liquids. For example, U.S. Pat. No. 3,701,478 (Tada) and U.S. Pat. No. 4,646,969 (Tada) and U.S. Pat. No. 4,591,077 (Corsette). However, such devices have proven ineffective for the application of a viscous pan coating which needs to be applied over a wide area as a mist without pooling.

Nozzle devices for pressurized containers have been proposed where the fluid exits the nozzle from two outlets. The exits for the outlets are on skew lines such that the output of the orifices meets tangentially outside the nozzle. The resulting turbulence is said to effect the breakup of the particles or agglomerates of liquids or solids in the propelling gas stream. See U.S. Pat. No. 3,406,913 (Frangos). Spray nozzles for fuel burners and water jets having converging jet passages outside the nozzle head are also shown in the prior art. See U.S. Pat. No. 1,055,789 (Papa-Fedoroff), U.S. Pat. No. 2,785,926 (Latase). Spray nozzles having converging jet-forming passages inside the nozzle head have also been proposed. U.S. Pat. No. 3,568,933 (Benson).

SUMMARY OF THE INVENTION

The present invention is directed to an improved pan coating dispensing system. The invention also relates to a method and apparatus for dispensing viscous pan coatings without the need to use aerosol propellants or to dilute the product with ethyl alcohol or other VOC pollutants. In addition, the hand pumpable, sprayable pan coating is water free and free of VOC's, and free of chlorofluoro hydrocarbons and is non-flammable. In another aspect of the invention a hand pump sprayer preferably of the trigger type is provided which is particularly useful on viscous fluids having a viscosity in excess of 60 cps. In addition, according to the invention, a spray nozzle is also provided.

It is an object of the invention to provide a pan coating dispensing system which can dispense viscous pan coatings without the need to dilute the pan coating with VOC solvents such as ethanol.

It is another object of the invention to provide pan coatings dispensing system that is water free. It is an object of the invention to provide a pan coating system that is free of chlorofluoro hydrocarbon and other aerosol propellants.

It is a further object of the invention to provide a hand pump sprayer which can readily spray viscous products having a viscosity over 60 cps in fine droplets.

Other, further objects will become apparent from the Specifications, Drawings and Claims.

According to the invention a dispensing system for viscous pan coatings is provided which includes a reservoir for holding a pan coating for dispensing. The viscous pan coating is preferably a lecithin, vegetable oil mixture having from 1 to 15% lecithin and 99 to 85% vegetable oil. A hand pump sprayer for delivering the pan coating under the pressure from reservoir preferably a container to a delivery conduit is provided. Preferably the hand pump sprayer is of the trigger type.

A nozzle assembly is interconnected with the delivery passageway or conduit from the hand pump sprayer. The nozzle assembly has a first and second passageway, preferably conduits which are connected to the delivery passageway or conduit and splits the fluid preferably pan coating exiting from the delivery passageway or conduit into two streams. The cross sectional flow area of the first and second conduit means is smaller than the cross sectional flow area of the delivery conduit so that the velocity of the pan coating increases upon entry into the first and second conduits located in the nozzle assembly.

Each conduit has a fluid outlet to the atmosphere which directs the fluid from the conduit to the atmosphere. The first and second conduits in combination with said fluid outlets define a discharge axis. The first fluid conduit discharge axis intersects the second fluid discharge axis at an impingement angle $\beta$ of from 10° to 170° preferably from 60° to 140° so that the pan coating exiting each outlet intersects at a point exterior to the nozzle. As a result the pan coating exiting the first outlet collides with the pan coating exiting from the second outlet to break the pan coating into small droplets to form a wide angle mist for application to a cooking surface. The impingement angle should be sufficiently high so that there is sufficient collision of the streams to form fine drops while at the same time preserving a sufficient forward velocity so that the pan coating can be sprayed on a cooking surface between 6 inches and 24 inches from the nozzle.

Desirably, the reduction in the cross sectional area between the delivery passageway and the fluid outlets is about ½ to 1/200 of the cross sectional area of the delivery passageway. Preferably this reduction is from ¼ to 1/100 and desirably about 1/50.

According to another aspect of the invention, a third and fourth passageway preferably conduits are provided which are located in the nozzle assembly. The third and fourth conduits are connected to the first and second conduits intermediate the first and second conduits and the first and second fluid outlets. The third and fourth conduits have a smaller cross sectional flow area than does the first and second conduits so that the velocity of the pan coating travelling from the first and second conduit into the third and fourth conduit increases. According to this embodiment prior to reaching the fluid outlets, the velocity of the pan coating is increased from the discharge conduit provided from the hand pump sprayer two times, once in the discharge to the first and second conduit, from the delivery conduit or passageway and a second time from the discharge from the first and second conduit to the smaller third and fourth conduits. The resulting pan coating dispensing system can dispense viscous pan coatings having viscosity above 60 cps in fine drops to provide improved spray coverage for the cooking surface.

In another aspect of the invention, a hand pump sprayer of the trigger type is provided which is particularly useful for the spraying of viscous fluids, particularly those having a viscosity of greater than 60 cps. The hand pump sprayer includes the nozzle assembly described above.

In still a further aspect of the invention, a nozzle assembly for introduction into hand pump spray dispensers as described above is provided.

The preferred embodiment of the present invention is illustrated in the drawings and examples. However, it should be expressly understood that the present invention should not be limited solely to the illustrative embodiment.

DESCRIPTION OF THE DRAWINGS

FIG. 1 is an exploded perspective view of a hand pump sprayer in accordance with the invention.

FIG. 5 is a front view of the nozzle cap according to the present invention.

DETAILED DESCRIPTION OF THE INVENTION

Figure 2:
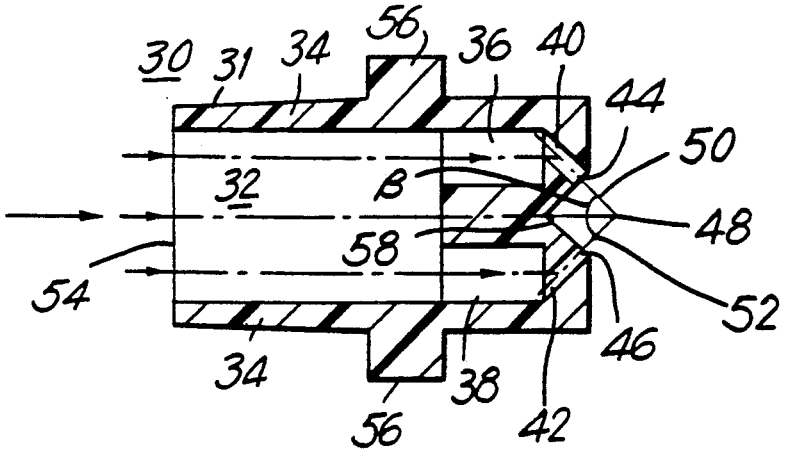
FIG. 2 is a section of the nozzle assembly for use in the invention looking down from the top.
Figure 3:
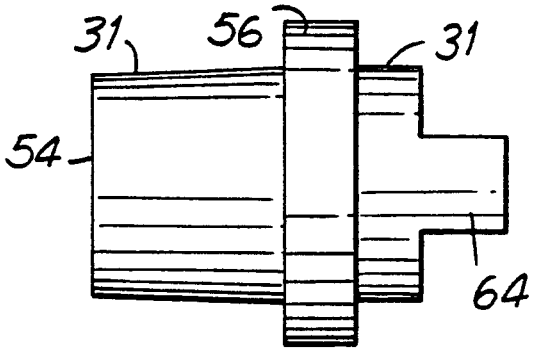
FIG. 3 is a sideview of the nozzle assembly for use in the invention.

The present invention is directed to an improved pan coating system for dispensing effective pan coatings without the use of hydrocarbon propellants or VOC solvents such as ethanol and without the use of water. According to the invention, a dispensing system for viscous pan coatings having a viscosity above 60 cps preferably from 60 cps to 100 cps most preferably from 70 to 85 cps is provided. In another aspect of the invention a hand pump sprayer for pumping viscous liquids is provided. In a still further aspect of the invention a spray nozzle is provided.

A viscous pan coating, preferably a vegetable oil, lecithin mixture of 1 to 15% lecithin and 99 to 85% vegetable oil is placed in a reservoir or container for pumping. A hand pump sprayer preferably of the trigger type is provided for delivering the pan coating under pressure from the container to a delivery passageway or conduit. A nozzle assembly is interconnected with the delivery conduit from the hand pump sprayer. Included within the nozzle assembly is a first and second passageway preferably conduits which are connected to the delivery conduit to split the pan coating exiting from the delivery conduit into two streams. The cross sectional flow area of the first and second conduits is smaller than the cross sectional flow area of the delivery passageway. As a result the velocity of the flowing pan coating is speeded up as it travels through the first and second conduits.

According to the invention of cross sectional area of the flow path of the pan coating decreases as it passes from the delivery passageway to first and second passageway. Preferably some of the cross sectional area of the first and second passageway is between 1/200

(0.005) and ½ (0.5) of that of the delivery passageway and preferably between 1/100 (0.01) and ¼ (0.25) of the cross sectional area of the delivery passageway and most preferably about 1/50 (0.02) the cross sectional area of the delivery passageway.

The first and second conduits have a fluid outlet to the atmosphere. Each fluid outlet has a discharge axis such that the pan coating exiting the first fluid outlet intersects the pan coating exiting the second fluid outlet at a point exterior to the nozzle assembly. As a result the pan coating exiting from the first outlet collides with the pan coating exiting from the second outlet to break the pan coating into small droplets and to form a wide angle spray of fine droplets preferably generally rectangular in nature for application to a cooking surface.

Referring now to the drawings, FIG. 1 is an exploded perspective representation of a trigger type spray pumper according to the subject invention. According to the invention, a hand sprayer 10 of the trigger type which is operated by moving the trigger handle 12 back and forth to pump liquid from a container 14 through tube 16 to supply a fluid under pressure to delivery conduit 18, is provided. Particularly useful in the invention is Continental Industrial Sprayer 922 which is modified in the nozzle area to accommodate the nozzle assembly hereinafter described. This sprayer is generally described in U.S. Pat. No. 3,701,478. In the 922 sprayer, the trigger moves a piston reciprocally within a cylindrical chamber to provide fluid under pressure from a reservoir to a delivery channel.

Referring to FIGS. 1 and 2 and as best seen in FIG. 2, a nozzle assembly 30 having a fluid inlet 54 and fluid outlets 44 and 46 is inserted within delivery conduit 18 of hand pump sprayer 10 for receipt of pressured fluid preferably pan coating flowing in delivery conduit 18 upon the pumping of trigger 12. Nozzle assembly 30 has a generally tubular body 31 and snugly slips into delivery conduit 18 and receive the end of valve spring 70 which is connected to valve 72 associated with the pump sprayer. See for example, the pump sprayer of U.S. Pat. No. 3,701,487 which is incorporated herein by reference. Preferably integral with the nozzle assembly 30, an annular collar 56, located between to inlet 54 and outlets 44 and 46, is provided to engage the side wall of sprayer housing 22 to prevent the nozzle assembly 30 from travelling too far into delivery conduit 18. Nozzle assembly 30 includes at its outlet end, projections 64 and 66 preferably twin projections which are separated by v-shaped notch 58. Outlets 44 and 46 are located at the top of the slanting side wall of v-shaped notch 58.

Figure 4:
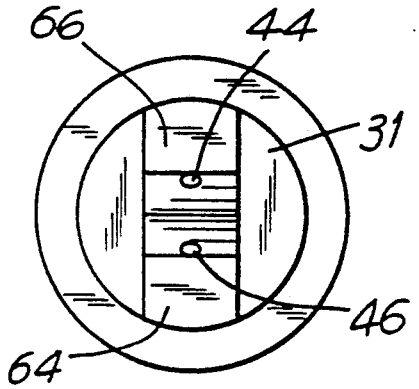
FIG. 4 is a front view of the nozzle assembly of the present invention.

Cap 20 includes annular member 68 which in installation will engage annular collar 56 to prevent nozzle assembly 30 from being dislodged from delivery conduit 18 during spraying. Nozzle cap 20 is provided for threaded mounting on the outside of sprayer housing 22. Referring to FIG. 4, nozzle cap 20 has a hollow threaded end 60 for mounting and threaded engagement about sprayer housing 22. Aperture 62 is provided for receipt of the head of nozzle assembly 30 which projects outwardly from nozzle cap 20 so that outlets 44 and 46 extend outside the top surface of the nozzle cap 20 to assure that the colliding pan coating and the resulting mist are not subjected to interference from the walls of nozzle cap 20.

The nozzle assembly 30 has a wide channel 32 which is substantially the same diameter as that of the delivery conduit 18 aside from thin walls 34. The channel 32 can optionally be funnel shaped. A first fluid conduit 36 and a second fluid conduit 38 are provided to split the pan coating flowing through conduit 32 into two flowing paths. The cross sectional area of the first and second conduits 36 and 38 are smaller than the cross sectional area of conduit 32 and of delivery conduit 18. Preferably the conduits 36 and 38 are twins that is, each is the same size and the same cross sectional area and are located in the same location on the left and right side of channel 32. Desirably the sum of the cross sectional areas of conduits 36 and 38 is about 0,25 that of channel 32. The velocity of the pressurized pan coating from delivery conduit 18 is increased as a result of the restriction on the cross sectional flow area as it passes through the first and second conduits.

A third conduit 40 and a fourth conduit 42 are provided at the end of conduits 36 and 38 to receive the speeded up pan coating flowing therein. Channels 40 and 42 have a cross sectional area smaller than that of channels 36 and 38. Preferably third conduit 40 and fourth conduit 42 are mirror images of one another. Preferably third conduit 40 is located in the same relative position to first conduit 36 as is fourth conduit 42 to second conduit 38. Most preferably third conduit 40 and fourth conduit 42 and both the same size and have the same cross sectional area. Desirably channels 40 and 42 have a cross sectional area which is about one-twelfth the cross sectional area of the first conduit 36 and second conduit 38. As a result, the velocity of the pan coating fluid traveling through third conduit 40 and fourth conduit 42, increases. Optionally three or more passageways and outlets may be substituted for the two passageways shown to split the fluid into multiple paths. The discharge axises for the three or more passageways should then intersect as do the two passageways shown herein so that the exiting fluid paths collide.

Figure 6:
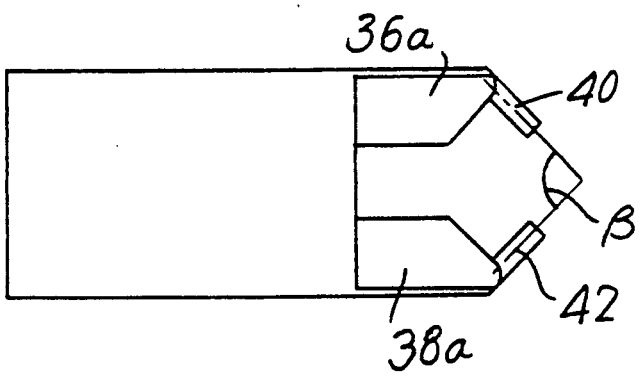
FIG. 6 is a section of an alternative embodiment of the nozzle assembly looking down from the top nozzle assembly.

Optionally as shown in FIGS. 6 the first and second conduits 36A and 38A can be generally rectangular in shape. The conduits can be tapered at the outlet end to more efficiently funnel the fluid to third and fourth conduits, 40 and 42.

Figure 7:
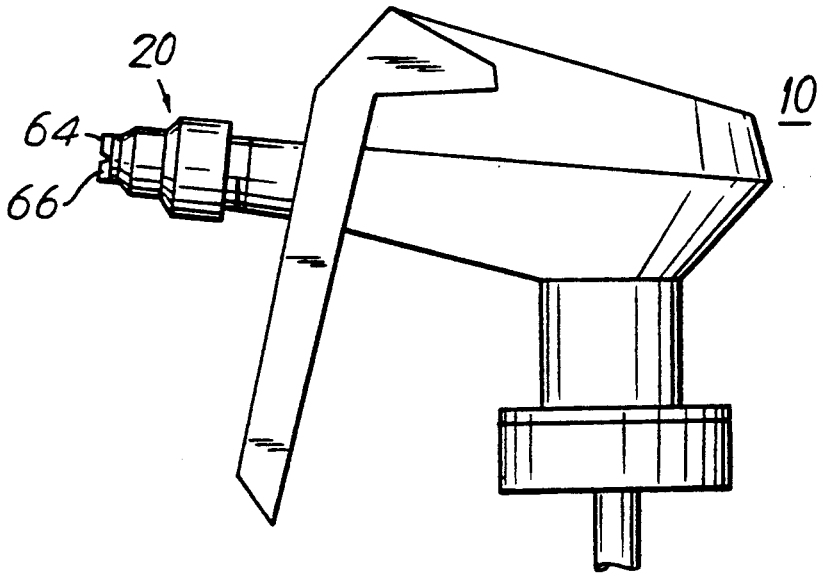
FIG. 7 is a perspective view of a hand pump sprayer according to the invention having the nozzle assembly installed.

FIG. 7 shows the nozzle assembly in place in sprayer 10. Projections 64 and 66 of nozzle assembly 30 project outward from Cap 20 to deliver the pan coating. It should be noted that in FIG. 7 the projections have been rotated so that they may be seen in the FIGURE whereas in operation the projection would be generally horizontal, that is rotated 90° from the position in FIG. 7.

In operation the pump sprayer 10 delivers pressurized pan coating through delivery conduit 18 by the action of trigger 12 and associated pistons and valves. The pan coating then travels through wide channel 32 to first and second conduits 36 and 38, wherein pan coating velocity is increased. The pan coating then travels through third and fourth conduits 40 and 42 where its velocity once again increases. The pan coating is dispensed through outlets 44 and 46. The discharge axis 50 of conduit 40 and discharge axis 52 of conduit 42 are oriented such that the pan coating exiting outlets 44 and 46 intersect at a point 48 outside the nozzle assembly. The intersection point 48 is preferably within one-half inch of outlets 44 and 46 most preferably within one-quarter of an inch of outlets 44 and 46. The speeding pan coating from outlets 44 and 46 collides and is broken into small droplets to create a wide angled spray preferably in a generally rectangular pattern for coverage of the cooking area needing application.

The angle formed by the intersection of the discharge axises and shown in FIG. 2 as $\beta$ is referred to as the impingement angle. The third and fourth conduits 40 and 42 are oriented such that the discharge axis 50 and 52 form an impingement angle $\beta$ which is from 10° to 170°. Preferably the angle is from 60° to 140°. An impingement angle of about 90° as shown in FIG. 2 is desirable.

Desirably, the pan coating is a vegetable oil, lecithin composition preferably from 1 to 15% lecithin and the remainder, vegetable oil. The pan coating most preferably is composed of 4 to 8% lecithin and the remaining vegetable oil. The vegetable oil component can be selected from a wide range of vegetable oils such as soybean oil, corn oil, safflower oil, sunflower oil, coconut oil, canola oil, olive oil, peanut oil; preferably a mixture of soybean oil and canola oil. Most preferably the pan coating composition is 87 parts by weight soybean oil, 6 parts by weight canola oil and 6 parts by weight lecithin and has a viscosity of about 81 cps at 66° F.

EXAMPLE 1

A spray nozzle was constructed according to the invention. The wide channel 32 had an inside diameter of 0.185 inches and a length of 0.29 inches. First and second conduits 36 and 38 had inside diameters of 0.062 inches and a length of 0.11 inches. Third and fourth conduits 40 and 42 had inside diameters of 0.018 inches and lengths of 0.06 inches. The angle of impingement $\beta$ was about 90°. The resulting nozzle was installed in a Continental 922 trigger spray. The sprayability of a pan coating composed of about 7 percent lecithin and about 93 percent vegetable oil having a viscosity of about 81 cps at 66° was tested. The pan coating was easily sprayed upon pumping the trigger. The spray pattern was generally rectangular and covered a wide surface area with fine drops of pan coatings.

EXAMPLE 2

A comparison of two different pan coating dispensing systems was made. VEGALENE brand pan coating which is 6 to 7% lecithin, 93 to 94% vegetable oil, was sprayed with the Continental 922 sprayer and with the sprayer of Example 1. A pan 13"×18" was used in the test. The pan coating was sprayed at a distance of 10" from the pan. The results of the tests were as follows:

| | Continental 922 | Sprayer of Example 1 |
|---|---|---|
| Number of sprays needed to cover pan | 6 | 5 |
| Total grams of VEGALENE delivered | 4.9 g | 4.1 g |
| Total grams VEGALENE/spray | .81 g | .82 g |
| Heavy coverage of VEGALENE/spray | 12.25 sq in | 4 sq in |
| Total area covered | 33 sq in | 47.25 sq in |

As shown in the above data, the pan coating dispensing system of Example 1 was superior to the Continental 922. There was a two-thirds decrease in the area where there was an undesirable high concentration of pan coating applied to the pan with the Example 1 system. In addition, there was a 40% increase in area covered per spray when using the Example 1 system.

The foregoing is considered as illustrative only to the principles of the invention. Further, since numerous changes and modifications will occur to those skilled in the art, it is not desired to limit the invention to the exact construction and operation shown and described above, and accordingly all suitable modifications and equivalents may be resorted to, falling within the scope of the invention.

We claim:

1. A dispensing system for viscous pan coatings comprising:

a fluid pan coating composed of a vegetable oil, lecithin mixture having 1% to 15% lecithin and the 99% to 85% vegetable oil and having a viscosity greater than 60 cps;

a reservoir for holding said pan coating for dispensing;

a hand pump sprayer for delivering the pan coating under pressure from said reservoir to a delivery passageway;

said delivery passageway having an outlet at one end of said passageway;

a nozzle assembly having an inlet end and an outlet end;

said nozzle assembly inlet interconnected with said outlet of said delivery passageway;

a first and second passageway located in said nozzle assembly to split the pan coating from said delivery passageway into two streams;

each said first and second passageway having a cross sectional area less than one half the cross sectional area of the delivery passageway so that the velocity of said pan coating increases in the first and second passageway from its velocity in said delivery passageway;

a first and second discharge means in fluid communication with said first and second passageway, said first discharge means having a first discharge axis to dispense the pan coating from said nozzle assembly and said second discharge means having a second discharge axis to dispense pan coating from said nozzle assembly;

said first and second discharge means including a first and second discharge outlet to separately direct the fluid flow from the first and second passageways beyond the nozzle assembly prior to the intersection of fluid flowing along the first and second discharge axis;

said first discharge axis and said second discharge axis intersecting at a collision point exterior to said nozzle assembly so that when said pan coating is pumped from said reservoir and discharged to the atmosphere the pan coating exiting from said first discharge means collides with the pan coating exiting from said second discharge means to break the pan coating into small droplets to form a wide angle mist for application to a cooking surface.

2. The viscous pan coating dispensing system of claim 1 further comprising:

a third and fourth passageway located in said nozzle assembly adjacent to and in fluid communication with said first and second passageway;

said third and fourth passageway having a smaller cross sectional area than that of said first and second passageway so that the velocity of the pan coating increases from its velocity in said first and second passageway;

said third and fourth passageway located intermediate to said first and second passageway and said first and second discharge means.

3. The dispensing system for viscous pan coatings according to claim 1 wherein said first and second passageways are a first conduit and a second conduit.

4. The dispensing system for viscous pan coatings according to claim 2 wherein said first, second, third and fourth passageways are a first, second, third and fourth conduit.

5. The dispensing system for viscous pan coatings according to claim 3 wherein the sum of the cross sectional areas of said first conduit and said second conduit is from ½ to 1/200 of the cross sectional area of said delivery passageway.

6. The dispensing system according to claim 5 wherein the sum of the cross sectional areas of said first and second conduit is ¼ to 1/100 of the cross sectional area of said delivery passageway.

7. The dispensing system according to claim 6 wherein the sum of the cross sectional areas of said first and second conduit is ¼ to about 1/50 of the cross sectional area of said delivery passageway.

8. The dispensing system according to claim 4 wherein the cross sectional area of said third and fourth conduits is between ½ and 1/200 of the cross sectional area of said delivery passageway.

9. The dispensing system for viscous pan coatings according to claim 8 wherein said first and second conduits are the same size and the sum of cross sectional areas of said first conduit and said second conduit is about one-quarter of the cross sectional area of said delivery passageway.

10. The dispensing system according to claim 6 wherein the cross sectional area of said third conduit is about one-twelfth the cross sectional area of said first conduit and the cross sectional area of said fourth conduit is about one-twelfth of the cross sectional area of the second conduit.

11. The dispensing system for viscous pan coatings according to claim 1 wherein said collision point is located less than one-half inch from said first and second discharge means.

12. The dispensing system for viscous pan coatings according to claim 1 wherein said collision point is located about one-quarter inch from said discharge means.

13. The dispensing system for viscous pan coatings according to claim 2 wherein said collision point is located less than one-half inch from said first and second discharge means.

14. The dispensing system for viscous pan coatings according to claim 2 wherein said collision point is located less than one-half inch from said first and second discharge means.

15. The dispensing system for viscous pan coatings according to claim 1 further comprising an annular collar located on said nozzle assembly to hold said nozzle assembly in fluid communication with said delivery passageway.

16. The viscous pan coating dispensing system according to claim 2 further comprising:

a first projection and a second projection located on the outlet end of said nozzle assembly;

a v-shaped notch separating said first and second projections;

said first and second discharge means located on opposite side walls of said v-shaped notch.

17. The viscous pan coating dispensing system according to claim 15 further comprising a first projection and a second projection located on the outlet end of said nozzle assembly;

a v-shaped notch separating said first and second projections;

said first and second discharge means located on opposite side walls of said v-shaped notch.

18. The viscous pan coating dispensing system according to claim 17 further comprising:

a threaded sprayer housing surrounding said delivery passageway;

a nozzle cap for threaded engagement on said threaded sprayer housing;

said nozzle cap having an aperture for receiving said projections so that said projections protrude from the surface of said cap;

an annular sleeve integral with and adjacent to the top of said cap for engagement of said annular collar of said nozzle assembly to prevent outward movement of said nozzle assembly during spraying.

19. A hand pump sprayer of the trigger type wherein pressurized fluid is brought from a reservoir to the outlet of a delivery passageway the improvement comprising:

a nozzle assembly having an inlet end and an outlet end;

said nozzle assembly inlet interconnected with said outlet of said delivery passageway;

a first and second passageway located in said nozzle assembly to split the fluid from said delivery passageway into two streams;

each said first and second passageway having a cross sectional area less than one half the cross sectional of the delivery passageway so that the velocity of said fluid increases in the first and second passageway from its velocity in said delivery passageway;

a first and second discharge means in fluid communication with said first and second passageway said first discharge means having a first discharge axis to dispense the fluid from said nozzle assembly and said second discharge means having a second discharge axis to dispense fluid from said nozzle assembly;

said first and second discharge means including a first and second discharge outlet to separately direct the fluid flow from the first and second passageways beyond the nozzle assembly prior to the intersection of fluid flowing along the first and second discharge axis;

said first discharge axis and said second discharge axis intersecting at a collision point exterior to said nozzle assembly so that when said fluid is pumped from said reservoir and discharged to the atmosphere the fluid exiting from said first discharge means collides with the fluid exiting from said second discharge means to break the fluid into small droplets to form a wide angle mist for application to a surface.

20. The hand pump sprayer according to claim 19 further comprising:

a third and fourth passageway located in said nozzle assembly adjacent to and in fluid communication with said first and second passageway;

the cross sectional areas of said third and fourth passageway being smaller than that of said first and second passageway so that the velocity of the fluid increases from its velocity in said first and second passageway;

said third and fourth passageway located intermediate to said first and second passageway and said first and second discharge means.

21. The hand pump sprayer according to claim 19 wherein said first and second passageways are a first and second conduit.

22. The hand pump sprayer according to claim 20 wherein said first, second, third and fourth passageways are a first, second, third and fourth conduict.

23. The hand pump sprayer according to claim 22 wherein the sum of cross sectional areas of said first conduit and said second conduit is from ½ to 1/200 of the cross sectional area of said delivery passageway.

24. The hand pump sprayer according to claim 23 wherein the sum of the cross sectional areas of said first and second conduit is ¼ to 1/100 of the cross sectional area of said delivery passageway.

25. The hand pump sprayer according to claim 24 wherein the sum of the cross sectional areas of said first and second conduits is ¼ to about 1/50 of the cross sectional area of said delivery passageway.

26. The hand pump sprayer according to claim 22 wherein the cross sectional areas of said third and fourth conduits is between ½ and 1/200 of the cross sectional area of said delivery passageway.

27. The hand pump sprayer according to claim 26 wherein the first and second conduits are the same size and the cross sectional area of said first and second conduits is about one-quarter of the cross sectional area of the delivery passageway.

28. The hand pump sprayer according to claim 27 wherein said first and second conduits are the same size and the cross sectional area of said third conduit is about one-twelfth the cross sectional area of said first conduit and the cross sectional area of said fourth conduit is about one-twelfth of the cross sectional area of the second conduit.

29. A hand pump sprayer of the trigger type according to claim 19 wherein pressurized fluid is brought from a reservoir to the outlet of a delivery passageway the improvement further comprising an annular collar located on said nozzle assembly to hold said nozzle assembly in fluid communication with said delivery passageway.

30. The hand pump sprayer according to claim 29 further comprising:

a first projection and a second projection located on the outlet end of said nozzle assembly;

a v-shaped notch separating said first and second projections;

said first and second discharge means located on opposite side walls of said v-shaped notch.

31. The hand pump sprayer according to claim 30 further comprising:

a nozzle cap for threaded engagement on said threaded sprayer housing;

said nozzle cap having an aperture for receiving said projections so that said projections protrude from the surface of said cap;

an annular sleeve integral with and adjacent to the top of said cap for engagement of said annular collar of said nozzle assembly to prevent outward movement of said nozzle assembly during spraying.

32. A hand pump sprayer of the trigger type according to claim 19 wherein said colliding fluid provides a generally rectangular spray pattern.

33. A dispensing system for viscous pan coatings according to claim 1 wherein said colliding pan coating provides a generally rectangular spray pattern.

34. The dispensing system according to anyone of claims 1 to 18 wherein said hand pump sprayer includes a trigger for moving a piston reciprocally within a cylindrical chamber to provide the liquid to be sprayed under pressure to a delivery passageway.

35. The product according to any one of claims 1 to 33 wherein said first and second discharge axises intersect to form an impingement angle $\beta$ of from 10° to 170°.

36. The product according to any one of claims 1 to 33 wherein said first and second discharge axises intersect to form an impingement angle $\beta$ of from 60° to 140°.

37. The product according to any one of claims 1 to 33 wherein said first and second discharge axises intersect to form an impingement angle $\beta$ of about 90°.

* * * * *